US005386640A

United States Patent [19]

Chen et al.

[11] Patent Number: 5,386,640

[45] Date of Patent: Feb. 7, 1995

[54] DRAFTING DEVICE

[76] Inventors: Chiang-Ming Chen; Kun-Mao Chen, both of No. 3, Lane 50 Chung Nan, Kuang Hsung Rd., Tai Ping Hsiang, Taichung Hsien, Taiwan, Prov. of China

[21] Appl. No.: 252,205

[22] Filed: Jun. 1, 1994

[51] Int. Cl.[6] ..... B43L 13/02

[52] U.S. Cl. ..... 33/444; 33/430

[58] Field of Search ..... 33/434, 438, 439, 441, 33/443, 444, 430

[56] References Cited

U.S. PATENT DOCUMENTS

| | | | |
|---|---|---|---|
| 1,482,606 | 2/1924 | Goldrick | 33/444 X |
| 3,283,410 | 11/1966 | Truhon | 33/444 |
| 4,934,061 | 6/1990 | Knight et al. | 33/443 X |

FOREIGN PATENT DOCUMENTS

| | | | |
|---|---|---|---|
| 2146353 | 3/1972 | Germany | 33/441 |
| 793067 | 4/1958 | United Kingdom | 33/443 |

*Primary Examiner*—Alvin Wirthlin

*Attorney, Agent, or Firm*—Webb Ziesenheim Bruening Logsdon Orkin & Hanson

[57] ABSTRACT

A drafting device includes a pair of magnetic boards securely mounted to upper and lower surfaces of a base frame respectively, a ruler movably engaged on the magnetic board, a pair of cavities defined in each of the four corners of the lower surface of the base frame, and a protrusion being formed between the pair of cavities. A guiding member is securely mounted to each of the four corners of the base frame and includes a locking block having a first wall member and a second wall member mounted on the upper and lower surfaces of the base frame respectively, a slot being defined in the second wall member through which the protrusion is received, a recess defined in an underside of the locking block between the first and second wall members and having a width equal to the distance between a bottom face of the cavity and the upper surface of the base frame. A guiding line loops around each of the guiding members and passes through two ends of the ruler.

5 Claims, 5 Drawing Sheets

DRAFTING DEVICE

BACKGROUND OF THE INVENTION

1. Field of the Invention

The present invention relates to a drafting device, and more particularly to a drafting device having a guiding member.

2. Related Prior Art

A conventional drafting device has a rectangular board and a guiding member attached to each of four corners of the rectangular board for introducing a guiding line. The guiding members are threadedly engaged to the board and are apt to damage the structure of the drafting device. In addition, the guiding member is not easy to be assembled and dismantled. Furthermore, the guiding member takes up considerable space of the board such that the ruler only has little space to move up and down on the board of the drafting device.

The present invention has arisen to mitigate and/or obviate the above-mentioned disadvantages of the conventional drafting device.

SUMMARY OF THE INVENTION

The primary objective of the present invention is to provide a drafting device having a guiding member which is easy to be assembled and dismantled and does not require use of any additional tools.

Another objective is to provide a drafting device whose guiding member is securely mounted to each of the four corners of the base frame without any threading engagement therewith, thereby avoiding damage to the structure of the base frame.

A further objective is to provide a drafting device whose guiding member takes up relatively small space of the base frame such that the ruler has broader space to move up and down on the magnetic board.

In accordance with one aspect of the present invention, there is provided a drafting device comprising a base frame having an upper surface, a lower surface, and four corners, a pair of magnetic boards securely mounted to the upper and lower surfaces of the base frame respectively, a ruler movably engaged on the magnetic board, a pair of cavities defined in each of the four corners of the lower surface of the base frame, and a protrusion being formed between the pair of cavities. A guiding member is securely mounted to each of the four corners of the base frame and includes a locking block having a first wall member and a second wall member mounted on the upper and lower surfaces of the base frame respectively, a slot being defined in the second wall member through which the protrusion is received, a recess defined in an underside of the locking block between the first and second wall members and having a width equal to the distance between a bottom face of the cavity and the upper surface of the base frame. A guiding line loops around each of the guiding members and passes through two ends of the ruler.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
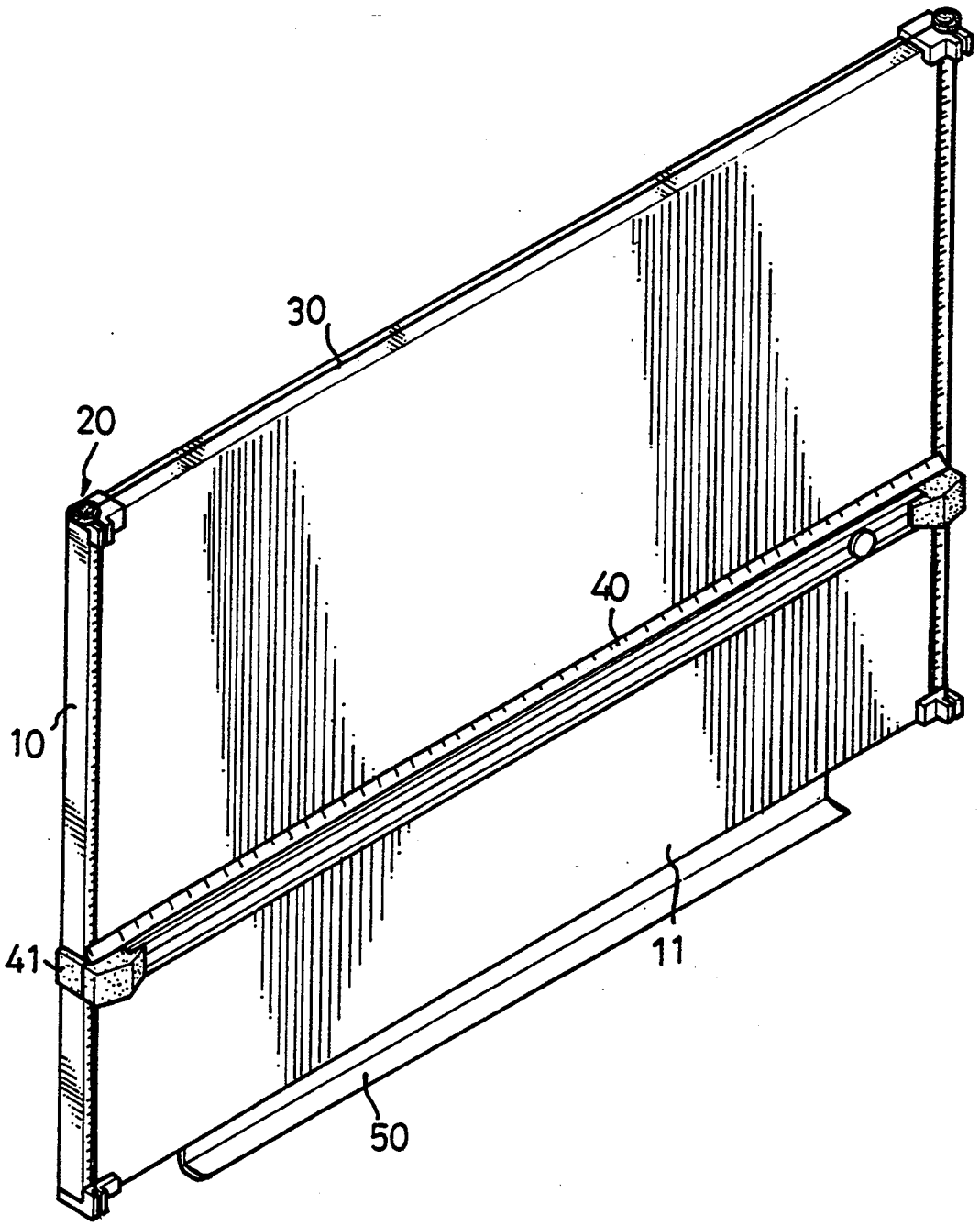
FIG. 1 is a perspective view of a drafting device in accordance with the present invention.
Figure 2:
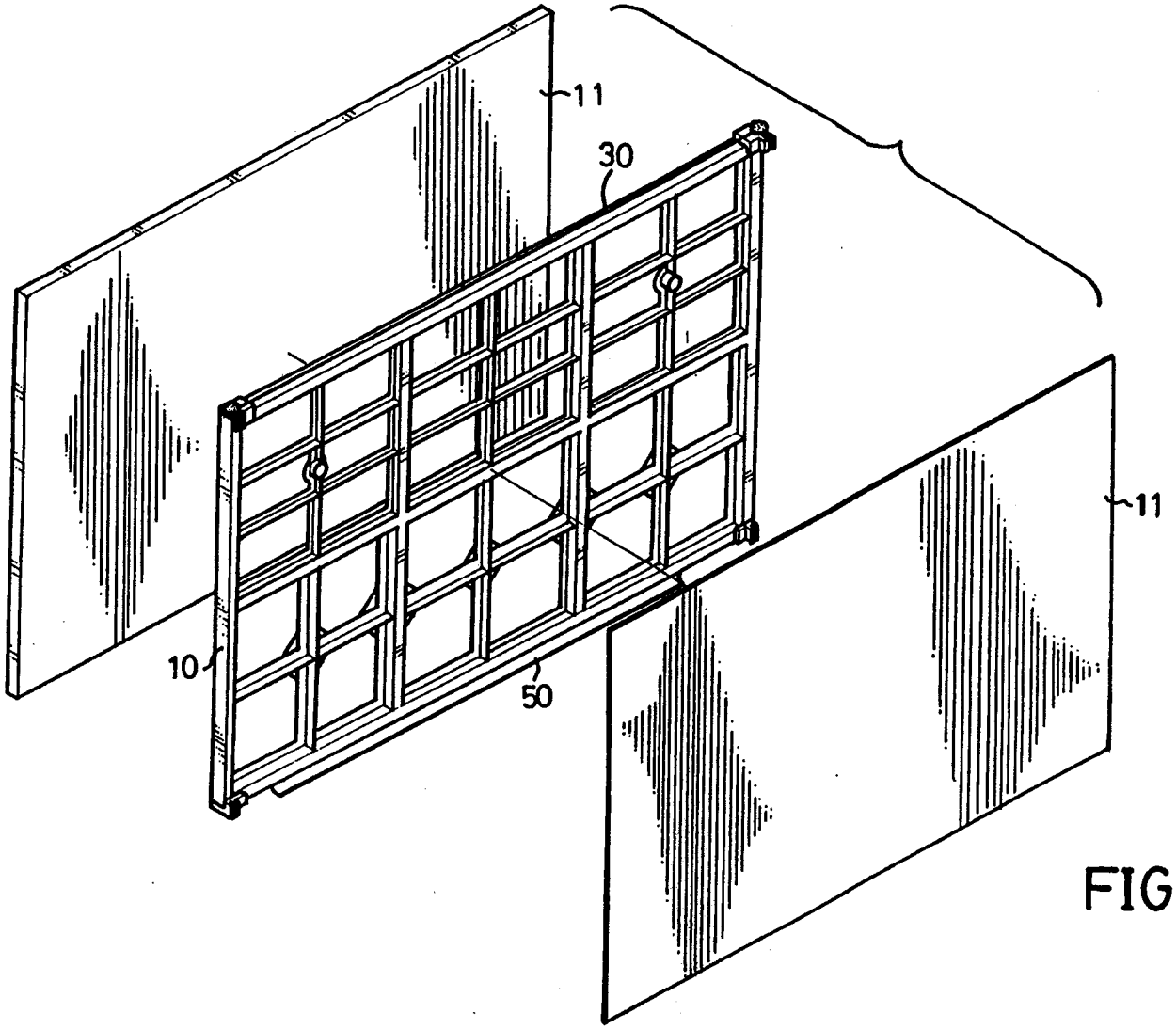
FIG. 2 is an exploded view of the drafting device as shown in FIG. 1.

Referring to the drawings, and firstly to FIGS. 1 and 2, a drafting device in accordance with the present invention comprises a lattice-shaped base frame 10 integrally formed by plastic injection molding process and having an upper surface, a lower surface, and four corners, a pair of rectangular magnetic boards 11 are securely mounted to the upper and lower surfaces of the base frame 10 respectively, a ruler 40 movably engaged on the magnetic board 11 and comprising at least one supporting arm 41 integrally formed on one end of the ruler 40 to facilitate movement of the ruler 40 on the magnetic board 11. An L-shaped tray 50 is integrally formed to the lower side of the base frame 10 for receiving objects, such as pencils, rubber bands, rulers, knives etc.

Figure 3:
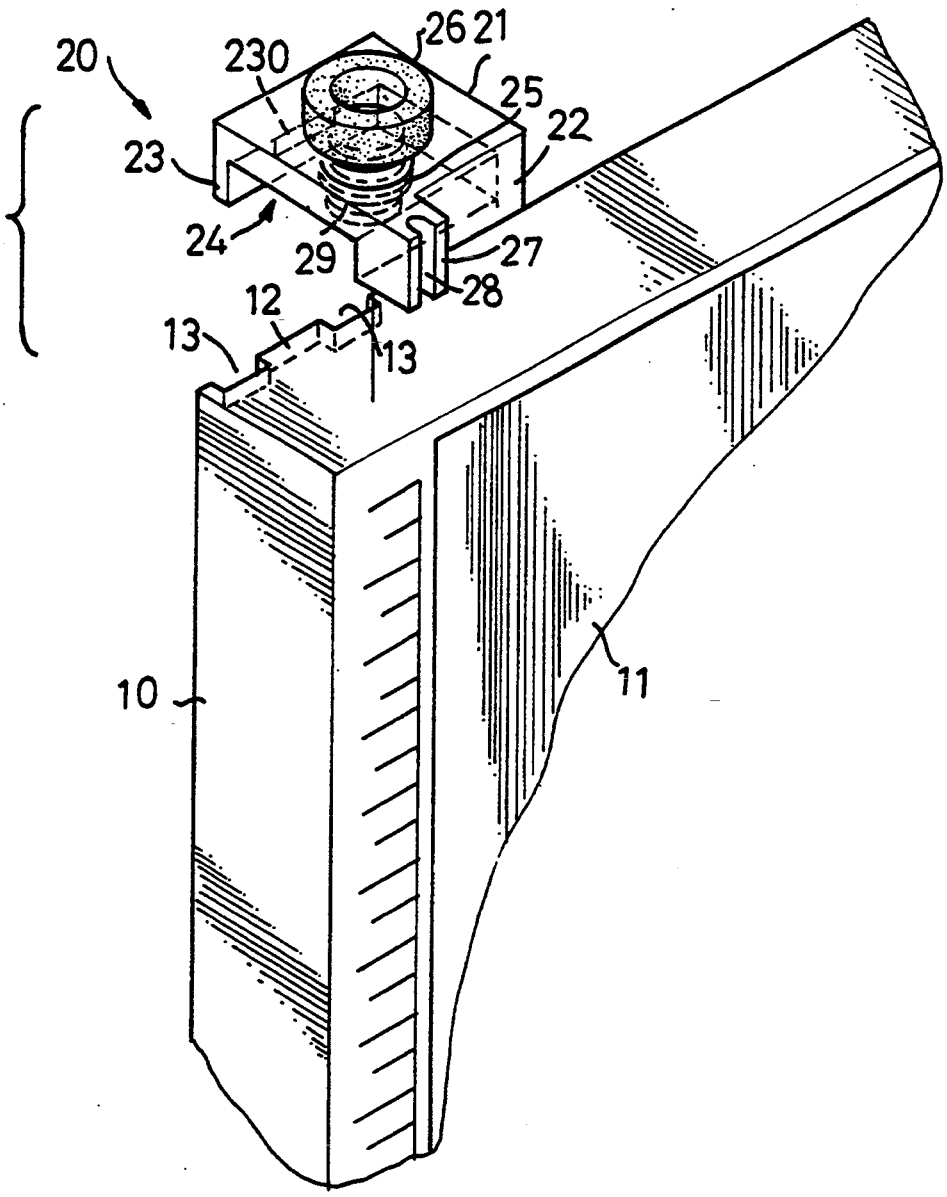
FIG. 3 is an enlarged exploded view showing the guiding member.
Figure 4:
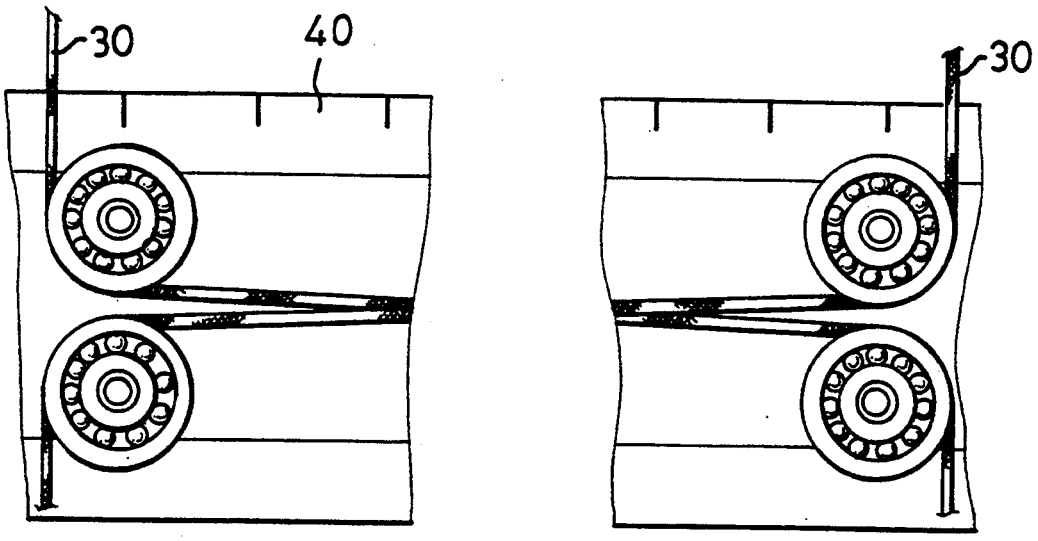
FIG. 4 is a schematical view showing how the guiding line passes through the ruler.
Figure 5:
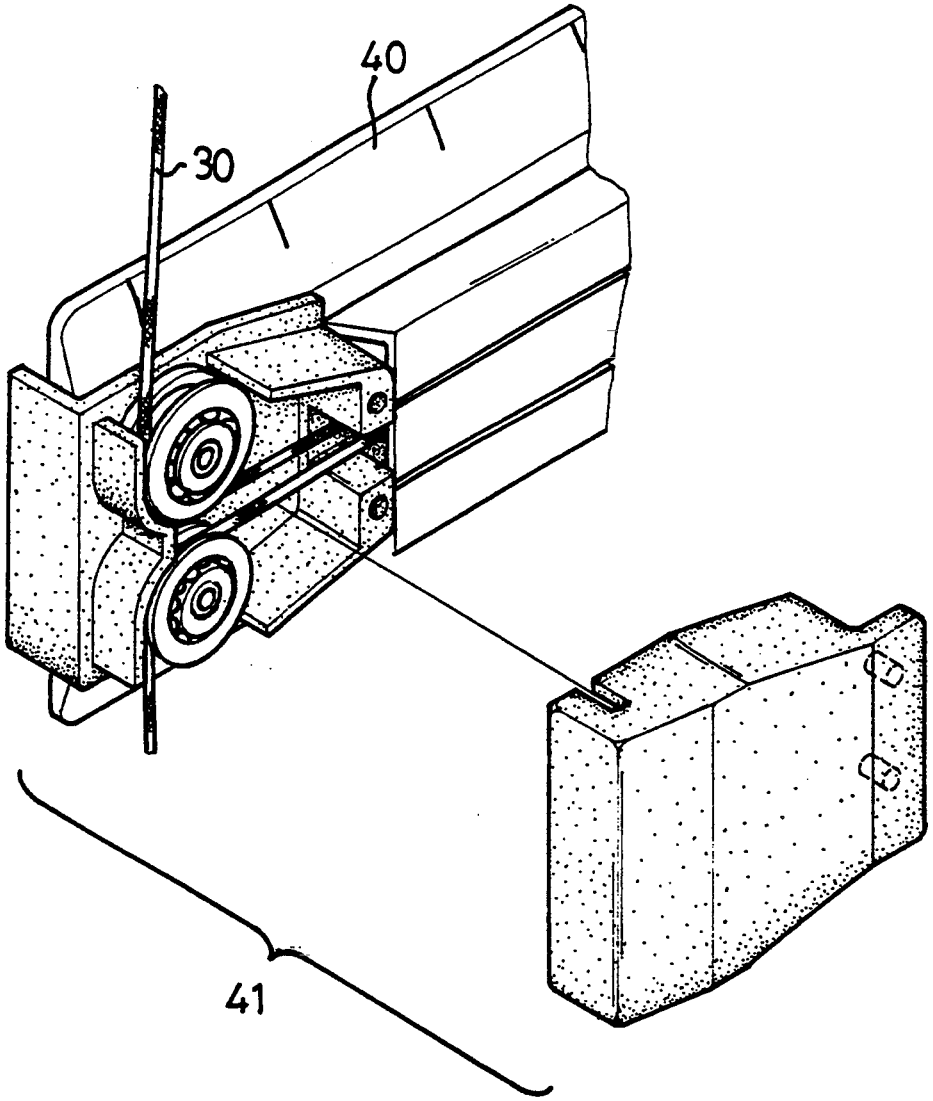
FIG. 5 is an enlarged exploded view showing the supporting arm of the ruler.

Referring to FIG. 3, a pair of cavities 13 are defined in each of the four corners of the lower surface of the base frame 10, a protrusion 12 being formed between the pair of cavities 13. A guiding member 20 is securely mounted to each of the four corners of the base frame 10 and includes a locking block 21 having a first wall member 22 and a second wall member 23 mounted on the upper and lower surfaces of the base frame 10 respectively, a slot 230 being defined in the second wall member 23 through which the protrusion 12 is received, a recess 24 defined in an underside of the locking block 21 between the first and second wall members 22 and 23 and having a width equal to the distance between a bottom face of the cavity 13 and the upper surface of the base frame 10 such that the guiding member 20 is able to be securely mounted to each of the four corners of the base frame 10. Referring to FIGS. 1 and 4 and 5, a guiding line 30 loops around each of the guiding members 20 and passes through two ends of the ruler 40 for guiding the ruler 40. The guiding line 30 is introduced by a roller (not labeled) from an upper position to a first end of the ruler 40, passing through the ruler 40 and is introduced by another roller at a second end of the ruler 40 to a lower position.

Again referring to FIG. 3, an extension 27 extends outwardly from the first wall member 22 and a vertical groove 28 is defined in the extension 27. A stud 29 is mounted in each of the locking blocks 21 and extends upwardly therefrom and a pair of washers 25 are mounted around each of the studs 29, the guiding line 30 passing between each pair of the washers 25 and being guided through each of the grooves 28, a fastener member 26 having a threaded hole defined therein for threaded engagement with each of the studs 29 to secure the guiding line 30 between the washers 25.

Accordingly, by such an arrangement, a drafting device in accordance with the present invention has the following advantages and benefits:

(1) The guiding member 20 is securely mounted to each of the four corners of the base frame 10 without any threading engagement with the base frame 10, thereby avoiding damage to the structure of the base frame 10.

(2) The guiding member 20 is easy to be assembled and dismantled and does not require use of any additional tools.

(3) The guiding member 20 takes up relatively small space of the base frame 10 such that the ruler 40 has broader space to move up and down on the magnetic board 11.

It should be clear to those skilled in the art that further embodiments of the present invention may be made without departing from the teachings of the present invention.

I claim:

1. A drafting device comprising:

a base frame (10) having an upper surface, a lower surface, and four corners;

a pair of magnetic boards (11) securely mounted to said upper and lower surfaces of said base frame (10) respectively;

a ruler (40) movably engaged on one of said magnetic boards (11);

a pair of cavities (13) defined in each of the four corners of said lower surface of said base frame (10), a protrusion (12) being formed between said pair of cavities (13);

a guiding member (20) securely mounted to each of the four corners of said base frame (10) and including:

a locking block (21) having a first wall member (22) and a second wall member (23) mounted on said upper and lower surfaces of said base frame (10) respectively, a slot (230) being defined in said second wall member (23) through which said protrusion (12) is received; and a recess (24) defined in an underside of said locking block (21) between said first and second wall members (22) and (23), said recess (24) having a width equal to the distance between a bottom face of said cavity (13) and said upper surface of said base frame (10); and a guiding line (30) looping around each of said guiding members (20) and passing through two ends of said ruler (40).

2. The drafting device in accordance with claim 1, wherein said base frame (10) is lattice-shaped.

3. The drafting device in accordance with claim 1, wherein said guiding member (20) further comprises:

an extension (27) extending outwardly from said first wall member (22), a vertical groove (28) being defined in said extension (27); and a stud (29) mounted in each of said locking blocks (21) and extending upwardly therefrom, a pair of washers (25) being mounted around each of said studs (29), said guiding line (30) passing between each pair of said washers (25) and being guided through each of said grooves (28), a fastener member (26) having a threaded hole defined therein for threaded engagement with each of said studs (29) to secure said guiding line (30) between said washers (25).

4. The drafting device in accordance with claim 1, further comprising at least one supporting arm (41) mounted on one end of said ruler (40) for facilitating movement of said ruler (40) on said magnetic board (11).

5. The drafting device in accordance with claim 4, wherein said supporting arm (41) is integrally formed to said end of said ruler (40).

* * * * *